US005203635A

United States Patent [19]

Freedman

[11] Patent Number: 5,203,635

[45] Date of Patent: Apr. 20, 1993

[54] LIGHTWEIGHT STENOGRAPHIC MACHINE WITH SEPARATE AND ADDITIONAL NUMBER KEYS

[76] Inventor: Kenneth Freedman, 246 Seventh Ave., Brooklyn, N.Y. 11215

[21] Appl. No.: 716,094

[22] Filed: Jun. 17, 1991

[51] Int. Cl.[5] ..... B41J 3/26

[52] U.S. Cl. ..... 400/91; 400/92; 400/94; 400/482

[58] Field of Search ..... 400/91, 92, 93, 94, 400/95, 482–486

[56] References Cited

U.S. PATENT DOCUMENTS

| | | | |
|---|---|---|---|
| 1,324,551 | 12/1919 | Ireland | 400/93 |
| 1,591,299 | 7/1926 | Etherton | 400/94 |
| 2,325,612 | 8/1943 | Kirkpatrick | 400/93 |
| 3,557,927 | 1/1971 | Wright et al. | 400/95 |
| 3,970,185 | 7/1976 | Shelton | 400/482 |
| 4,307,970 | 12/1981 | McGaughey, Jr. et al. | 400/482 |
| 4,765,764 | 8/1988 | Lefler | 400/91 |

FOREIGN PATENT DOCUMENTS

| | | | |
|---|---|---|---|
| 2542888 | 9/1984 | France | 400/94 |

OTHER PUBLICATIONS

IBM Technical Disclosure Bulletin vol. 19 No. 9 Feb. 1977; "Stenographic Reading Device", Proceedings of the Annual Meeting of the Association for Computing Machinery, 1973; R. Smith, Northwestern University.

*Primary Examiner*—Edgar S. Burr
*Assistant Examiner*—Lynn D. Hendrickson
*Attorney, Agent, or Firm*—Charles E. Baxley

[57] ABSTRACT

A stenographic machine includes a keyboard having a first area containing keys designated for at least some of numerals "1", "2", "3", "4", "5", "6", "7", "8" and "9", a second area containing keys designated for consonant letters, a third area containing, in order from left to right, keys designated for vowel letters "A", "O", "E" and "U", a first additional key designated for numeral "5" and a second additional key designated for numeral "0". The additional keys are located elsewhere than in the first area and are preferably directly below the keys designated for the letters "A" and "O".

6 Claims, 2 Drawing Sheets

LIGHTWEIGHT STENOGRAPHIC MACHINE WITH SEPARATE AND ADDITIONAL NUMBER KEYS

BACKGROUND OF THE INVENTION

This invention relates to a lightweight stenographic machine and more particularly to such a machine with separate and additional number keys.

A patentability search hereon has revealed the following prior United States Patents:

| U.S. Pat. No. | Date | Inventor |
|---|---|---|
| 1,324,551 | December 9, 1919 | W. S. Ireland |
| 1,591,299 | July 6, 1926 | G. E. Etherton |
| 2,325,612 | August 3, 1943 | W. V. Kirkpatrick |
| 3,970,185 | July 20, 1976 | D. L. Shelton |
| 4,765,764 | August 23, 1988 | J. P. Lefler |

Only Lefler and Shelton will be described here.

Lefler appears to be an all-electronic system with a stenographic transcription and translating assembly with word processing capabilities. Horizontal and vertical groupings of keys indicate generation of signals characterized in consonant and vowel letters or non-phonetic language construction. Command instructions call for transcribing, translation or word processing.

Shelton presents a syllabic typewriter keyboard to produce typed copy with conventional spelling, the keyboard being particularly characterized by all the control keys being located at the ends of the keyboard, except the upper case shift keys located elsewhere. Separate keys are provided for numerals.

The advent of all-electronic operation of stenographic machines has enabled substantial weight reduction and has made possible the achievement of other advantages as well, such as enabling adjustment to a lighter and shallower depth of touch, and enabling any place in a transcript to be found without a manual search of the transcript. Furthermore, the all-electronic feature provides simultaneous translation capability without extra hardware.

The present invention presents an improvement over the most pertinent prior art, as typified by Lefler and Shelton, by providing optimal keyboard configuration for an all-electronic stenographic machine with minimal keyboard size and goes further than Shelton as far as ease of use goes. By providing separate numeral keys, Shelton gets rid of the clumsy number bar, and is a step in the right direction, in that individual keys are easier to hit than a number bar.

The present invention goes further than Shelton by providing additional numeral keys for numerals "5" and "0", in a location where the additional keys are most convenient.

Also, the present invention enables use of either state-of-the art technologies including flashram and static ram, or non-volatile memory including a conventional hard disk drive, in either case with a 3.5 inch diskette drive.

It is an important object of the invention to provide a stenographic machine that attains the foregoing and other advantages.

SUMMARY OF THE INVENTION

The invention presents a stenographic machine including a keyboard having a first area containing keys designated for at least some of the numerals "1", "2", "3", "4", "5", "6", "7", "8", "9" and "0", a second area containing keys designated for consonant letters, a third area containing, in order from left to right, keys designated for vowel letters "A", "O", "E" and "U", and a fourth area containing a first additional key designated for numeral "5" and a second additional key designated for numeral "0".

The keys of the first area are arranged in an uppermost horizontal row, the keys of the second area are arranged below the first area, the keys of the third area are arranged in a horizontal row below the second area, and the keys of the fourth area are arranged in a horizontal row below the third area, with the first additional key (for the numeral "5") below the key designated for the letter "A" and the second additional key (for the numeral "0") immediately to the right of the first additional key and immediately below the key designated for the letter "O".

The first area contains, in order from left to right, keys designated for all of the numerals "1", "2", "3", "4", "5", "6", "7", "8" and "9" and a key designated for a dollar sign symbol "$". Thus, the keyboard contains two keys designated for the numeral "5".

The second area contains an upper horizontal row containing, in order from left to right, keys designated for letters "T", "P", "H", "F", "P", "L", "T" and "D" and a lower horizontal row containing, in order from left to right, keys designated for letters "K", "W", "R", "R", "B", "G", "S" and "Z". In addition, the keyboard contains a double-sized key designated for one letter "S" at the left-hand end of the second area, and a double-sized key designated for an asterisk (*) located between the keys designated for the letters "H" and "F" in the upper horizontal row and between the keys designated for the letters "R" in the lower horizontal row. Thus, the keyboard contains two keys (one of which is double sized) each designated for the letter "S", two keys each designated for the letter "T", two keys each designated for the letter "P", one key designated for each of the letters "H", "F", "L", D", "K", "W", "B", "G" and "Z", and two keys each designated for the letter "R".

The machine further includes an LCD display board and the keyboard contains various additional response-initiating command keys.

The manner in which the invention achieves the foregoing objects and advantages will appear hereinafter.

DESCRIPTION OF THE INVENTION

Figure 1:
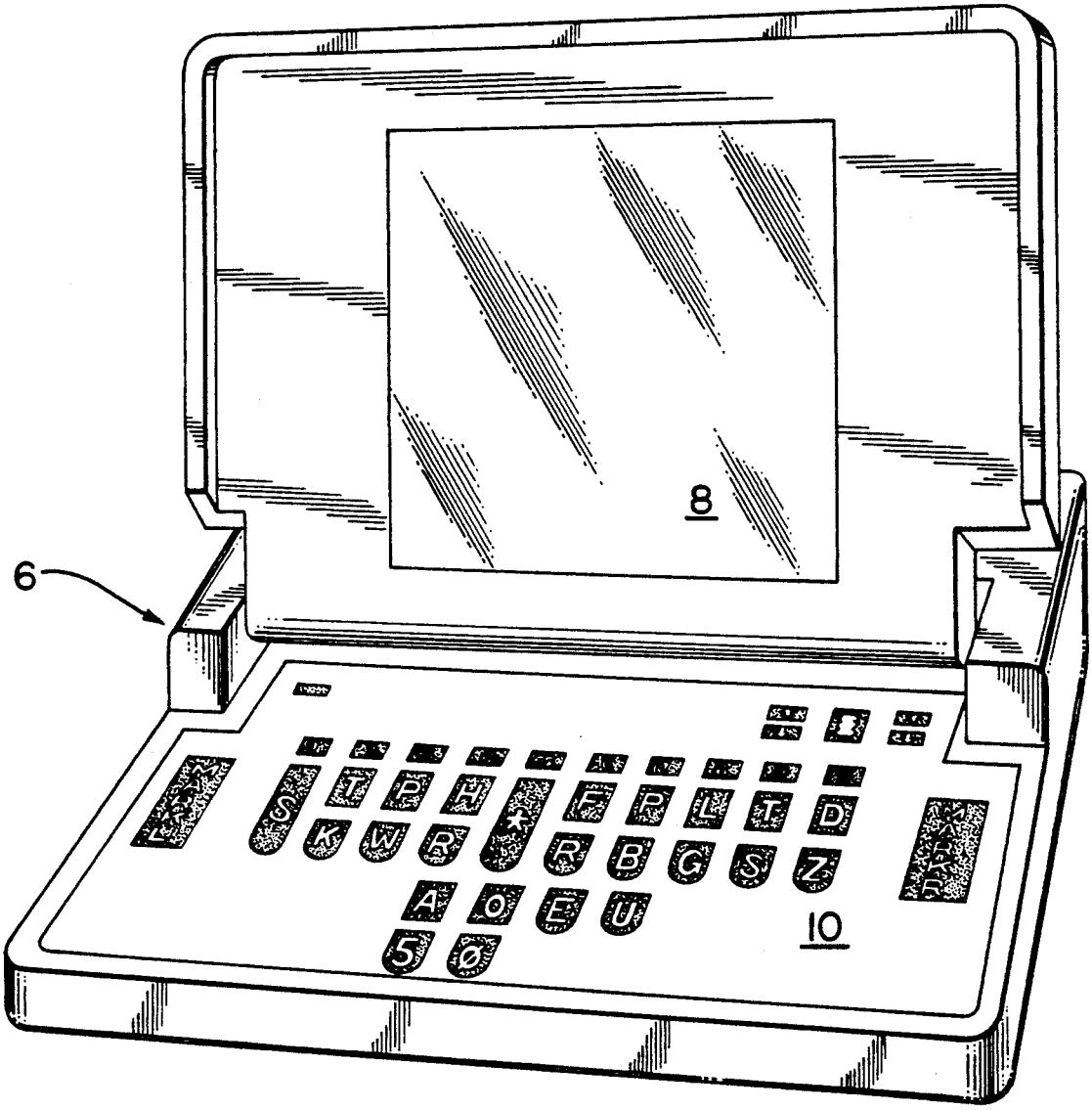
FIG. 1 is a perspective view of a lightweight stenographic machine embodying the invention.

FIG. 1 shows in perspective a lightweight stenographic machine 6 that is a preferred embodiment of the invention. Machine 6 has an LCD display board 8 and a keyboard 10.

Figure 2:
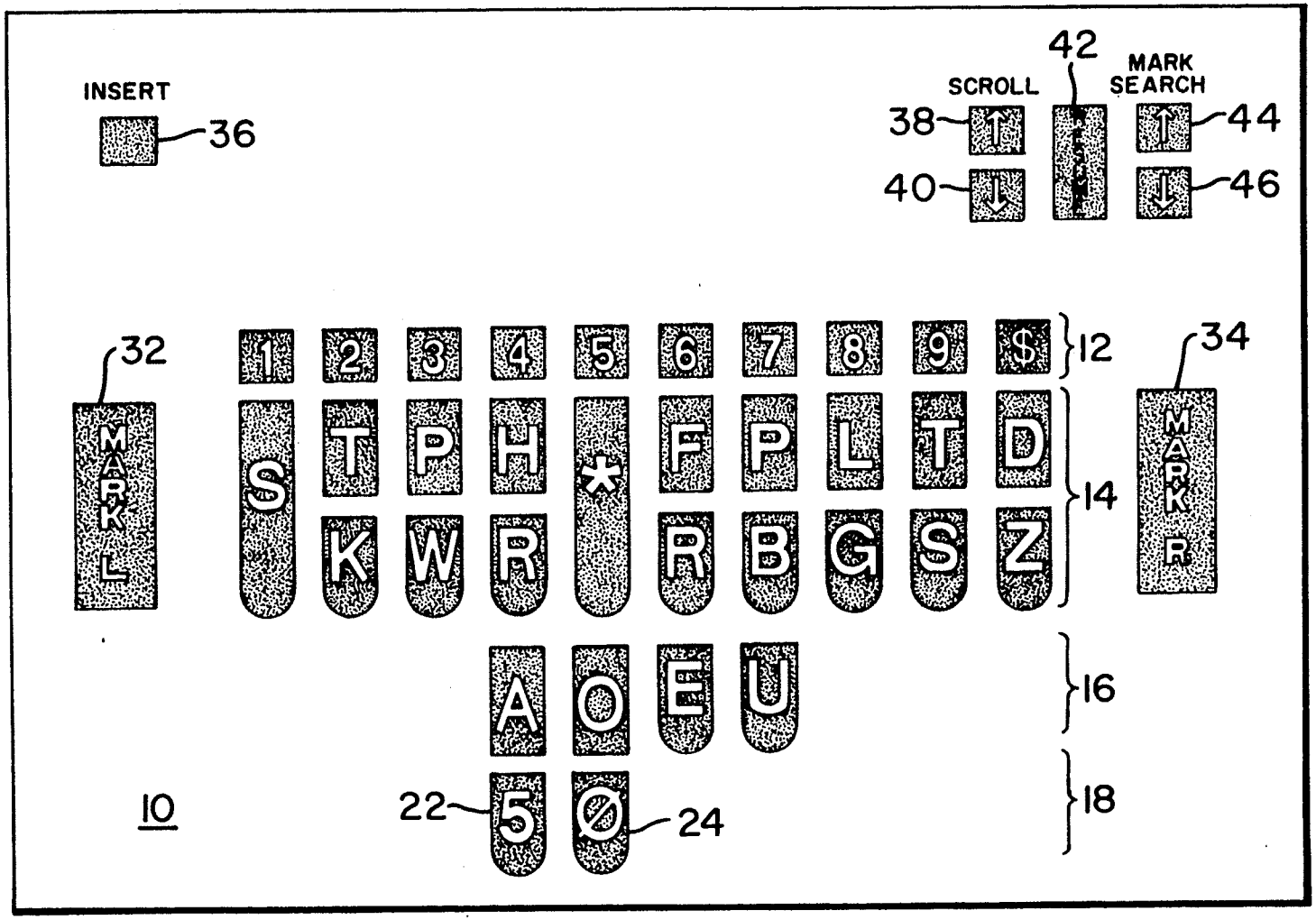
FIG. 2 is an enlarged plan view of the keyboard of the machine of FIG. 1.

FIG. 2 clearly shows the makeup and layout of keyboard 10. Keyboard 10 has a first area 12 containing keys designated for at least some (and as shown all) of numerals "1", "2", "3", "4", "5", "6", "7", "8" and "9", as well as a key designated for a dollar sign symbol ($).

Keyboard 10 also has a second area 14 containing keys designated for consonant letters, a third area 16 containing, in order from left to right, keys designated for vowel letters "A", "O", "E" and "U", and a fourth area 18 containing a first additional key 22 designated for numeral "5" and a second additional key 24 designated for numeral "0".

The keys of first area 12 are arranged in an uppermost horizontal row, the keys of second area 14 are arranged below first area 12, the keys of third area 16 are arranged in a horizontal row below second area 14, and the keys of fourth area 18 are arranged in a horizontal row below third area 16, with first additional key 22 below the key in third area 16 designated for the letter "A" and with second additional key 24 immediately to the right of first additional key 22 and immediately below the key in third area 16 designated for the letter "O".

First area 12 contains, in order from left to right, keys designated for all of numerals "1", "2", "3", "4", "5", "6", "7", "8" and "9", and a key designated for a dollar sign symbol "$". Thus, keyboard 10 contains two keys designated for numeral "5".

Second area 14 contains an upper horizontal row containing, in order from left to right, keys designated for letters "S", "T", "P", "H", "F", "P", "L", "T" and "D", and a lower horizontal row containing, in order from left to right, keys designated for letters "S", "K", "W", "R", "R", "B", "G", "S" and "Z", whereby keyboard 10 contains two keys (one double-sized) each designated for the letter "S", two keys each designated for the letter "T", two keys each designated for the letter "P", one key designated for each of letters "H", "F", "L", "D", "K", "W", "B", "G" and "Z", and two keys each designated for the letter "R" and one key (doublesized) designated for an asterisk (*).

Machine 6 further includes various additional response-initiating command keys 32, 34, 36, 38, 40, 42, 44 and 46 that are believed to be self-explanatory. For example, keys 32 and 34 mean to place marks on the paper next to the left edge and the right edge, respectively.

The invention well attains the stated objects and advantages, among others.

The disclosed details are exemplary only and are not to be taken as limitations on the invention except as those details may be included in the appended claims.

What is claimed is:

1. A stenographic machine including a keyboard having a first area containing keys designated for at least some of numerals "1", "2", "3", "4", "5", "6", "7", "8" and "9", a second area containing keys designated for consonant letters, a third area containing, in order from left to right, keys designated for vowel letters "A", "0", "E" and "U", and a fourth area containing a first additional key designated for numeral "5" and a second additional key designated for numeral "0".

2. A machine according to claim 1 wherein said keys of said first area are arranged in an uppermost horizontal row, said keys of said second area are arranged below said first area, said keys of said third area are arranged in a horizontal row below said second area, said first additional key being located immediately below said key designated for letter character "A" and said second additional key being located immediately to the right of said first additional key and immediately below said key designated for letter character "O".

3. A machine according to claim 1 wherein said first area contains in order from left to right, keys designated for all of said numeral characters "1", "2", "3", "4", "5", "6", "7", "8" and "9", whereby said keyboard contains two keys each designated for the number character "5".

4. A machine according to claim 3 wherein said second area includes an upper horizontal row containing, in order from left to right, keys designated for letters "S", "T", "P", "H", "F", "P", "L", "T" and "D", and a lower horizontal row containing, in order from left to right, keys designated for letters "S", "K", "W", "R", "R", "B", "G", "S" and "Z", whereby said keyboard contains three keys each designated for the letter "S", two keys each designated for the letter "T", two keys each designated for the letter "P", one key designated for each of the letters "H", "F", "L", "D", "K", "W", "B", "G" and "Z", and two keys each designated for the letter "R".

5. A machine according to claim 1 further comprising an LCD display.

6. A machine according to claim 3 wherein said second additional key is the only key designated for numeral character "0".

* * * * *